US007571643B2

(12) United States Patent
Sugiura

(10) Patent No.: US 7,571,643 B2
(45) Date of Patent: Aug. 11, 2009

(54) APPARATUS AND METHOD FOR DOWNHOLE DYNAMICS MEASUREMENTS

(75) Inventor: Junichi Sugiura, Houston, TX (US)

(73) Assignee: PathFinder Energy Services, Inc., Houston, TX (US)

( * ) Notice: Subject to any disclaimer, the term of this patent is extended or adjusted under 35 U.S.C. 154(b) by 323 days.

(21) Appl. No.: 11/454,019

(22) Filed: Jun. 15, 2006

(65) Prior Publication Data

US 2007/0289373 A1 Dec. 20, 2007

(51) Int. Cl.
*E21B 44/00* (2006.01)

(52) U.S. Cl. ..... 73/152.46

(58) Field of Classification Search ..... 73/152.43, 73/152.46–152.48

See application file for complete search history.

(56) References Cited

U.S. PATENT DOCUMENTS

| | | | | |
|---|---|---|---|---|
| 3,525,406 | A * | 8/1970 | Hart | 340/853.6 |
| 3,968,473 | A | 7/1976 | Patton et al. | |
| 4,715,451 | A | 12/1987 | Bseisu et al. | |
| 4,773,263 | A | 9/1988 | Lesage et al. | |
| 4,958,125 | A | 9/1990 | Jardine et al. | |
| 5,226,332 | A | 7/1993 | Wassell | |
| 5,313,829 | A | 5/1994 | Paslay et al. | |
| 5,358,059 | A * | 10/1994 | Ho | 175/45 |
| 5,448,227 | A * | 9/1995 | Orban et al. | 340/854.4 |
| 5,448,911 | A | 9/1995 | Mason | |
| 5,603,386 | A | 2/1997 | Webster | |
| 5,721,376 | A | 2/1998 | Pavone et al. | |
| 5,864,058 | A | 1/1999 | Chen | |
| 6,065,332 | A | 5/2000 | Dominick | |
| 6,068,394 | A | 5/2000 | Dublin, Jr. | |
| 6,092,610 | A | 7/2000 | Kosmala et al. | |
| 6,216,802 | B1 | 4/2001 | Sawyer | |
| 6,233,524 | B1 | 5/2001 | Harrell et al. | |
| 6,267,185 | B1 | 7/2001 | Mougel et al. | |
| 6,268,726 | B1 | 7/2001 | Prammer et al. | |
| 6,427,783 | B2 | 8/2002 | Krueger et al. | |
| 6,453,239 | B1 * | 9/2002 | Shirasaka et al. | 701/220 |

(Continued)

FOREIGN PATENT DOCUMENTS

| | | | |
|---|---|---|---|
| WO | WO-97/15749 | A | 5/1997 |

(Continued)

OTHER PUBLICATIONS

Chen, D.C.-K, Comeaux, B., Gillespie, G., Irvine, G., and Wiecek, B., "Real-Time Downhole Torsional Vibration Monitor For Improving Tool Performance and Bit Design," IADC/SPE Drilling Conference, Feb. 21-23, 2006, Miami, Florida, SPE99193.

*Primary Examiner*—Hezron E. Williams
*Assistant Examiner*—John Fitzgerald

(57) ABSTRACT

Aspects of this invention include a rotary steerable steering tool having a sensor arrangement for measuring downhole dynamic conditions. Rotary steerable tools in accordance with this invention include a rotation rate measurement device disposed to measure a difference in rotation rates between a drive shaft and an outer, substantially non-rotating housing. A controller is configured to determine a stick/slip parameter from the rotation rate measurements. Exemplary embodiments may also optionally include a tri-axial accelerometer arrangement deployed in the housing for measuring lateral vibrations and bit bounce. Downhole measurement of stick/slip and other vibration components during drilling advantageously enables corrective measures to be implemented when dangerous dynamic conditions are encountered.

25 Claims, 4 Drawing Sheets

U.S. PATENT DOCUMENTS

| | | | | |
|---|---|---|---|---|
| 6,518,756 | B1 | 2/2003 | Morys et al. | |
| 6,581,699 | B1 * | 6/2003 | Chen et al. | 175/61 |
| 6,608,565 | B1 | 8/2003 | Van Steenwyk et al. | |
| 6,681,633 | B2 | 1/2004 | Schultz et al. | |
| 6,742,604 | B2 | 6/2004 | Brazil et al. | |
| 7,222,681 | B2 * | 5/2007 | Jones et al. | 175/38 |
| 2001/0045300 | A1 | 11/2001 | Fincher et al. | |
| 2002/0124652 | A1 | 9/2002 | Schultz et al. | |
| 2004/0206170 | A1 | 10/2004 | Chen et al. | |
| 2004/0222019 | A1 | 11/2004 | Estes et al. | |
| 2004/0251898 | A1 | 12/2004 | Morys et al. | |
| 2005/0001737 | A1 | 1/2005 | Baron et al. | |
| 2005/0034985 | A1 | 2/2005 | Zamanzadeh et al. | |
| 2005/0132794 | A1 * | 6/2005 | Spross et al. | 73/152.03 |
| 2005/0150694 | A1 | 7/2005 | Schuh | |
| 2007/0107937 | A1 * | 5/2007 | Sugiura | 175/45 |

FOREIGN PATENT DOCUMENTS

| | | | |
|---|---|---|---|
| WO | WO-00/37764 | A2 | 6/2000 |

* cited by examiner

APPARATUS AND METHOD FOR DOWNHOLE DYNAMICS MEASUREMENTS

RELATED APPLICATIONS

None.

FIELD OF THE INVENTION

The present invention relates generally to downhole tools, for example, including three-dimensional rotary steerable tools (3DRS ). More particularly, embodiments of this invention relate to an apparatus and method for measuring the dynamic conditions of a rotary steerable tool, and in particular, a method and apparatus for measuring stick/slip conditions.

BACKGROUND OF THE INVENTION

Directional control has become increasingly important in the drilling of subterranean oil and gas wells, for example, to more fully exploit hydrocarbon reservoirs. Two-dimensional and three-dimensional rotary steerable tools are used in many drilling applications to control the direction of drilling. Such steering tools commonly include a plurality of force application members (also referred to herein as blades) that may be independently extended out from and retracted into a housing. The blades are disposed to extend outward from the housing into contact with the borehole wall and to thereby displace the housing from the centerline of a borehole during drilling. The housing is typically deployed about a shaft, which is coupled to the drill string and disposed to transfer weight and torque from the surface (or from a mud motor) through the steering tool to the drill bit assembly.

It is well known in the art that severe dynamic conditions are often encountered during drilling. Commonly encountered dynamic conditions include, for example, bit bounce, lateral shock and vibration, and stick/slip. Bit bounce includes axial vibration of the drill string, often resulting in temporary lift off of the drill bit from the formation ("bouncing" of the drill bit off the bottom of the borehole). Bit bounce is known to reduce the rate of penetration (ROP) during drilling, cause excessive fatigue damage to BHA components, and may even damage the well in extreme conditions. Lateral vibrations are those which are transverse to the axis of the drill string. Such lateral vibrations are commonly recognized as the leading cause of drill string and BHA failures and may be caused, for example, by bit whirl and/or the use of unbalanced drill string components. Stick/slip refers to a tensional vibration induced by friction between drill string components and the borehole wall. Stick/slip is known to produce instantaneous drill string rotation speeds many times that of the nominal rotation speed of the table. In stick/slip conditions a portion of the drill string or bit sticks to the borehole wall due to frictional forces often causing the drill string to temporarily stop rotating. Meanwhile, the rotary table continues to turn resulting in an accumulation of tensional energy in the drill string. When the tensional energy exceeds the static friction between the drill string and the borehole, the energy is released suddenly in a rapid burst of drill string rotation. Instantaneous downhole rotation rotates have been reported to exceed four times that of the rotary table. Stick/slip is known to cause severe damage to downhole tools, as well as connection fatigue, and excess wear to the drill bit and near-bit stabilizer blades. Such wear commonly results in reduced ROP and loss of steer ability in deviated boreholes. These harmful dynamic conditions not only cause premature failure and excessive wear of the drilling components, but also often result in costly trips (tripping-in and tripping-out of the borehole) due to unexpected tool failures and wear. Furthermore, there is a trend in the industry towards drilling deeper, smaller diameter wells where stick/slip becomes increasingly problematic. Problems associated with premature tool failure and wear are exacerbated (and more expensive) in such wells.

The above-described downhole dynamic conditions are known to be influenced by drilling conditions. By controlling such drilling conditions an operator can sometimes mitigate against damaging dynamic conditions. For example, bit bounce and lateral vibration conditions can sometimes be overcome by reducing both the weight on bit and the drill string rotation rate. Stick/slip conditions can often be overcome via increasing the drill string rotation rate and reducing weight on bit. The use of less aggressive drill bits also tends to reduce bit bounce, lateral vibrations, and stick/slip in many types of formations. The use of stiffer drill string components is further known to sometimes reduce stick/slip. While the damaging dynamic conditions may often be mitigated as described above, reliable measurement and identification of such dynamic conditions can be problematic. For example, lateral vibration and stick/slip conditions are not easily quantified by surface measurements. In fact, such dynamic conditions are sometimes not even detectable at the surface, especially at vibration frequencies above about 5 hertz.

Downhole dynamics measurement systems have been known in the art for at least 15 years. For example, U.S. Pat. No. 4,958,125 to Jardine et al discloses an accelerometer-based method for measuring the centripetal acceleration of a drill string in a borehole, and thereby determining instantaneous rotation rates of the drill string. More recently, U.S. Pat. No. 6,518,756 to Morys et al discloses a system and apparatus for determining the lateral velocity of a drill string within a borehole. While these, and other known systems and methods, may be serviceable in certain applications, there is yet need for further improvement. For example, the above-described methods each require at least four accelerometers deployed about the periphery of the drill string (Morys et al also requires the deployment of two additional magnetometers). The use of such dedicated sensors tends to increase costs and expend valuable BHA real estate (e.g., via the introduction of a dedicated sub). Also, such dedicated sensors tend to increase power consumption and component counts and, therefore, the complexity of MWD, LWD, and directional drilling tools, and thus tend to reduce reliability of the system. Moreover, dedicated sensors must typically be deployed a significant distance above the drill bit.

Therefore there exists a need for an improved apparatus and method for making downhole dynamics measurements. In particular, there exists a need for a rotary steerable deployment of such a dynamics measurement system and method.

SUMMARY OF THE INVENTION

The present invention addresses one or more of the above-described drawbacks of prior art tools and methods. Aspects of this invention include a rotary steerable steering tool having a sensor arrangement for measuring downhole dynamic conditions. In one exemplary embodiment, a rotary steerable tool in accordance with this invention includes a rotation rate sensor disposed to measure a difference in rotation rates between a drive shaft and an outer, substantially non-rotating housing. The rotation rate sensor may include, for example, a Hall-effect sensor. The rotary steerable tool may also optionally include a tri-axial accelerometer arrangement deployed in the housing for measuring lateral vibrations and bit bounce. Stick/slip conditions may be determined at the steering tool, for example, by comparing instantaneous and time-averaged rotation rate measurements. Drill string vibration may be determined via lateral and axial acceleration measurements.

Exemplary embodiments of the present invention may advantageously provide several technical advantages. For example, in one exemplary embodiment, real-time, downhole measurement of stick/slip and other vibration components during drilling enables corrective measures to be implemented when dangerous dynamic conditions are encountered. Moreover, exemplary method embodiments of this invention advantageously utilize existing rotation rate and accelerometer sensors deployed in a rotary steerable housing. This enables simultaneous determination of downhole dynamics, inclination, tool face, and average drill string rotation, which allows for increased reliability of the sensor system by reducing component counts.

In one aspect the present invention includes a rotary steerable tool configured to operate in a borehole. The rotary steerable tool includes a shaft and a housing deployed about the shaft, the shaft disposed to rotate substantially freely in the housing. The rotary steerable tool also includes a rotation rate measurement device disposed to measure a rotation rate of the shaft relative to the housing. The rotation rate measurement device includes at least one sensor and at least one marker, the sensor disposed to send an electrical pulse to a controller each time one of the markers and the sensor rotate past one another, the controller being configured to calculate a stick/slip parameter from the electric pulses.

In another aspect this invention includes a rotary steerable tool configured to operate in a borehole. The rotary steerable tool includes a shaft and a housing deployed about the shaft, the shaft being disposed to rotate substantially freely in the housing. The rotary steerable tool also includes a rotation rate measurement device disposed to measure a rotation rate of the shaft relative to the housing. The rotation rate measurement device includes at least one sensor and a plurality of markers, the sensor disposed to send an electrical pulse to a controller each time one of the markers and the sensor rotate past one another. The rotary steerable tool further includes a tri-axial accelerometer set deployed in the housing, the accelerometer set disposed to measure acceleration of the housing. The controller is configured to determine (i) instantaneous and average rotation rates of the shaft from the electrical pulses, (ii) a stick/slip parameter from the instantaneous rotation rates, (iii) instantaneous and average tri-axial acceleration components from the accelerometer measurements, (iv) borehole inclination and gravity tool face from the average tri-axial acceleration components, and (v) bit bounce and lateral vibration parameters from the instantaneous tri-axial acceleration components.

In another aspect the present invention includes a method for determining a stick/slip parameter downhole during drilling of subterranean borehole. The method includes rotating a string of tools in a borehole, the string of tools including a rotary steerable tool and a drill bit rotationally coupled with a drill string, the rotary steerable tool including a shaft disposed to rotate substantially freely in a housing, the rotary steerable tool further including a rotation rate measurement device disposed to measure a rotation rate of the shaft relative to the housing, the rotation rate measurement device having at least one sensor and a plurality of markers, the sensor disposed to send an electrical pulse to a controller each time one of the markers and the sensor rotate past one another. The method further includes processing the electrical pulses to determine the stick/slip parameter.

The foregoing has outlined rather broadly the features of the present invention in order that the detailed description of the invention that follows may be better understood. Additional features and advantages of the invention will be described hereinafter which form the subject of the claims of the invention. It should be appreciated by those skilled in the art that the conception and the specific embodiments disclosed may be readily utilized as a basis for modifying or designing other methods, structures, and encoding schemes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
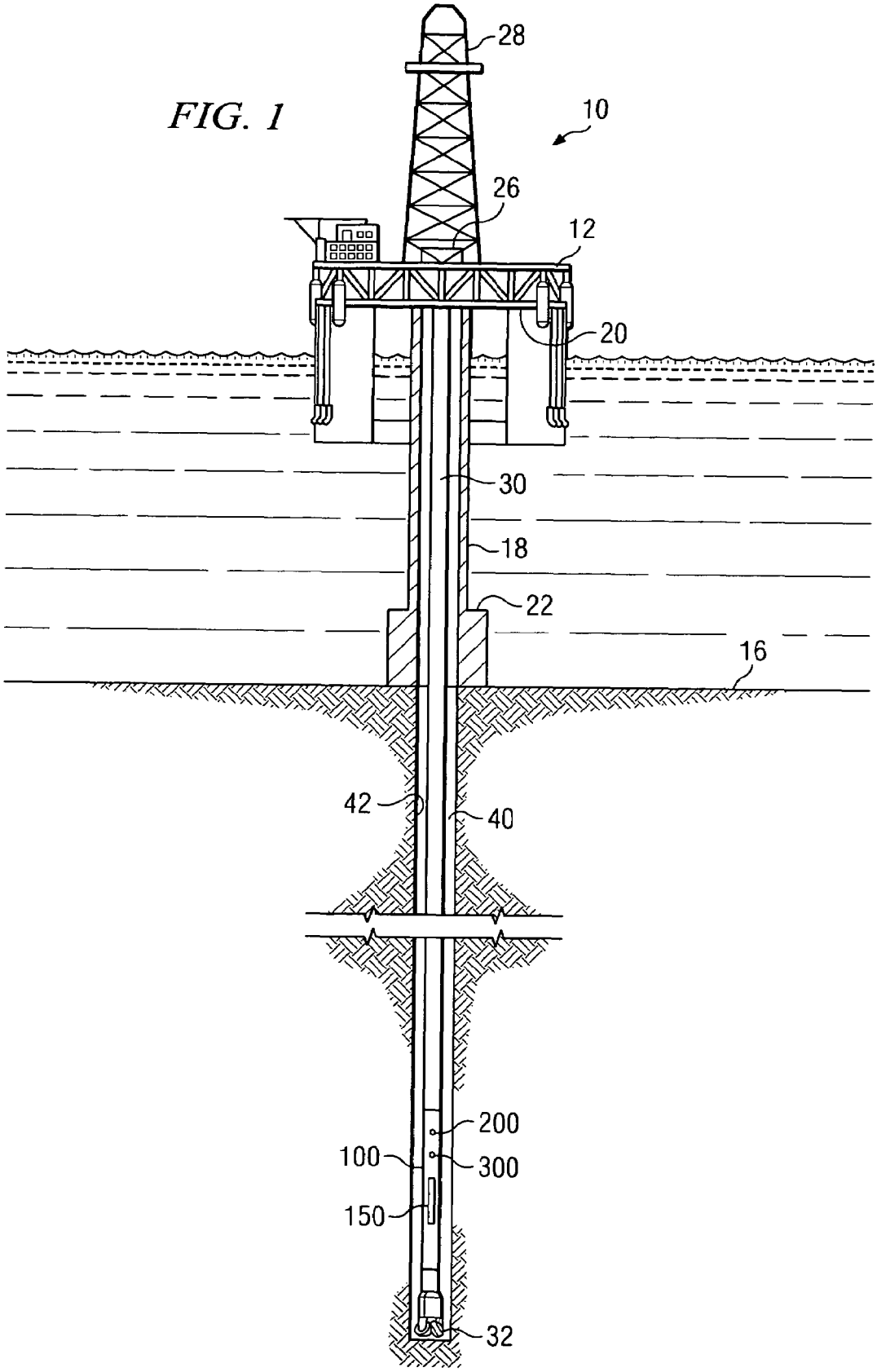
FIG. 1 depicts a drilling rig on which exemplary embodiments of the present invention may be deployed.

Referring first to FIGS. 1, 2, 3, and 7, it will be understood that features or aspects of the embodiments illustrated may be shown from various views. Where such features or aspects are common to particular views, they are labeled using the same reference numeral. Thus, a feature or aspect labeled with a particular reference numeral on one view in FIGS. 1, 2, 3, 5, and 7 may be described herein with respect to that reference numeral shown on other views.

FIG. 1 illustrates a drilling rig 10 suitable for utilizing exemplary rotary steerable tool and method embodiments of the present invention. In the exemplary embodiment shown on FIG. 1, a semisubmersible drilling platform 12 is positioned over an oil or gas formation (not shown) disposed below the sea floor 16. A subsea conduit 18 extends from deck 20 of platform 12 to a wellhead installation 22. The platform may include a derrick 26 and a hoisting apparatus 28 for raising and lowering the drill string 30, which, as shown, extends into borehole 40 and includes a drill bit 32 and a directional drilling tool 100 (such as a three-dimensional rotary steerable tool). In the exemplary embodiment shown, a rotary steerable tool 100 includes one or more, usually three, blades 150 disposed to extend outward from the tool 100 and apply a lateral force and/or displacement to the borehole wall 42. The extension of the blades deflects the drill string 30 from the central axis of the borehole 40, thereby changing the drilling direction. Exemplary embodiments of rotary steerable tool 100 further include first and second sensor arrangements 200 and 300, which may be utilized in combination to measure downhole dynamics of the drill string 30. Drill string 30 may further include a downhole drilling motor, a mud pulse telemetry system, and one or more additional sensors, such as LWD and/or MWD tools for sensing downhole characteristics of the borehole and the surrounding formation. The invention is not limited in these regards.

It will be understood by those of ordinary skill in the art that methods and apparatuses in accordance with this invention are not limited to use with a semisubmersible platform 12 as illustrated in FIG. 1. This invention is equally well suited for use with any kind of subterranean drilling operation, either offshore or onshore.

Figure 2:
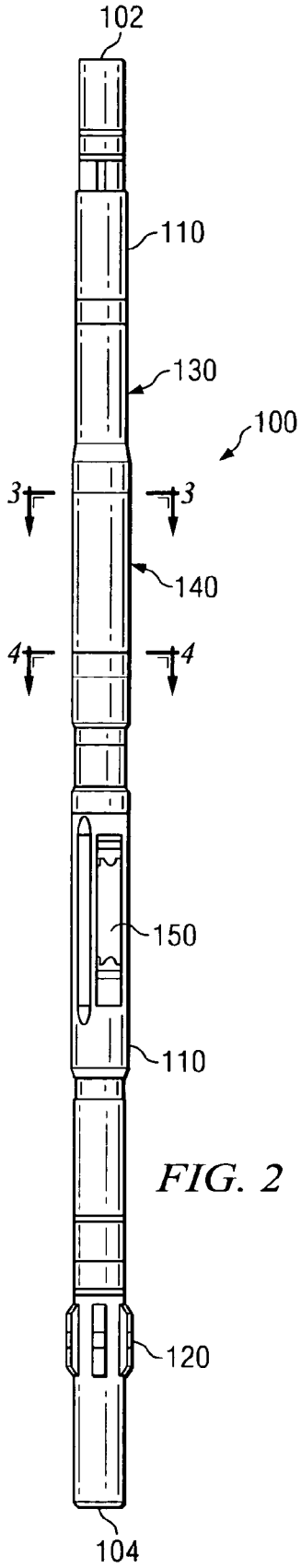
FIG. 2 is a perspective view of the steering tool shown on FIG. 1.

Turning now to FIG. 2, one exemplary embodiment of rotary steerable tool 100 from FIG. 1 is illustrated in perspective view. In the exemplary embodiment shown, rotary steerable tool 100 is substantially cylindrical and includes threaded ends 102 and 104 (threads not shown) for connecting with other bottom hole assembly (BHA) components (e.g., connecting with the drill bit at end 104). The rotary steerable tool 100 further includes a housing 110 and at least one blade 150 deployed, for example, in a recess (not shown) in the housing 110. Rotary steerable tool 100 further includes hydraulics 130 and electronics 140 modules (also referred to herein as control modules 130 and 140) deployed in the housing 110. In general, the control modules 130 and 140 are configured for sensing and controlling the relative positions of the blades 150 and may include substantially any devices known to those of skill in the art, such as those disclosed in U.S. Pat. No. 5,603,386 to Webster or U.S. Pat. No. 6,427,783 to Krueger et al.

To steer (i.e., change the direction of drilling), one or more of blades 150 are extended and exert a force against the borehole wall. The rotary steerable tool 100 is moved away from the center of the borehole by this operation, altering the drilling path. It will be appreciated that the tool 100 may also be moved back towards the borehole axis if it is already centered. To facilitate controlled steering, the tool 100 is constructed so that the housing 110, which houses the blades 150, remains stationary, or substantially stationary, with respect to the borehole during steering operations. The rotation rate of the housing is typically less than 0.1 rpm during drilling, although the invention is not limited in this regard. If the desired change in direction requires moving the center of the rotary steerable tool 100 a certain direction from the centerline of the borehole, this objective is achieved by actuating one or more of the blades 150. By keeping the blades 150 in a substantially fixed position with respect to the circumference of the borehole (i.e., by preventing rotation of the housing 110), it is possible to steer the tool without constantly extending and retracting the blades 150. The housing 110, therefore, is constructed in a rotationally non-fixed or floating fashion.

In general, increasing the offset (i.e., increasing the distance between the tool axis and the borehole axis) tends to increase the curvature (dogleg severity) of the borehole upon subsequent drilling. In the exemplary embodiment shown, rotary steerable tool 100 includes near-bit stabilizer 120, and is therefore configured for "point-the-bit" steering in which the direction (tool face) of subsequent drilling tends to be in the opposite direction (or nearly the opposite; depending, for example, upon local formation characteristics) of the offset between the tool axis and the borehole axis. The invention is not limited to the mere use of a near-bit stabilizer. It is equally well suited for "push-the-bit" steering in which there is no near-bit stabilizer and the direction of subsequent drilling tends to be in the same direction as the offset between the tool axis and borehole axis.

The rotation of the drill string and the drilling force it exerts are transmitted through the rotary steerable tool 100 to the drill bit 32 by a rigid shaft 115. The shaft 115 is typically a thick-walled, tubular member capable of withstanding the large forces encountered in drilling situations. The tubular shaft 115 typically also includes a relatively small bore that is required to allow flow of drilling fluid to the drill bit 32. Since the shaft 115 is rotationally coupled with the drill string and the housing 110 is substantially non-rotating with respect to the borehole, the rotation rate of the shaft 115 relative to that of the housing has been found to be a reliable indicator of drill string rotation. For example, in one application using a "push-the-bit" configuration, housing 110 was found to rotate one revolution every 2 or 3 hours (a rotation rate of less than 0.01 rpm), while the shaft was rotating at rate between about 100 and 200 rpm. Moreover, as described in more detail below, measurement of the instantaneous rotation rate of the shaft 115 has been found to be a reliable indicator of stick/slip conditions during drilling.

Figure 3:
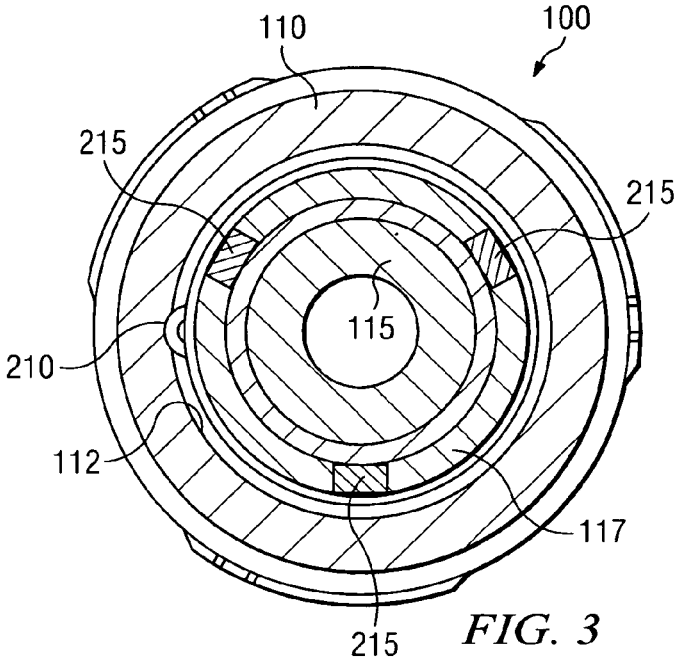
FIG. 3 depicts, in cross section, a portion of the steering tool shown on FIG. 2 showing one exemplary sensor arrangement in accordance with this invention
Figure 5:
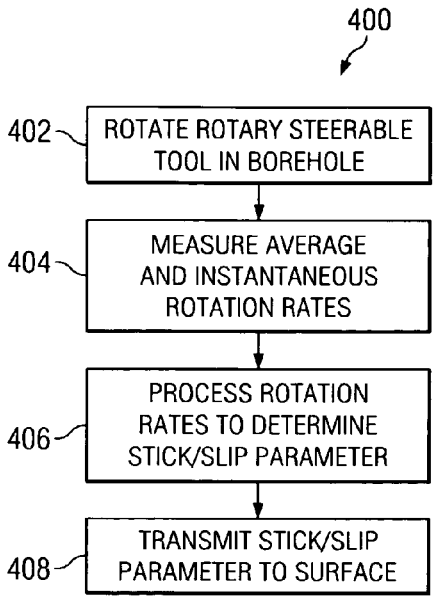
FIG. 5 depicts, in cross section, another portion of the steering tool shown on FIG. 2 showing another exemplary sensor arrangement in accordance with this invention.

FIGS. 3 and 5 show exemplary embodiments of sensor arrangements deployed in the rotary steerable tool 100. A cross section of one exemplary embodiment of sensor arrangement 200 is shown in FIG. 3. Sensor arrangement 200 is also referred to as a rotation rate measurement device. The sensor arrangement 200 is disposed to measure the difference in rotation rates of the shaft 115 and the housing 110. In the exemplary embodiment shown on FIG. 3, sensor arrangement 200 includes one or more sensors 210 deployed on an inner surface 112 of the housing 110. Sensor arrangement 200 further includes a plurality of markers 215 deployed in a ring member 117 about the shaft 115. In use, sensor(s) 210 sends an electrical pulse to a controller (described in more detail below) each time one of the markers 215 rotates by the sensor 210. In the exemplary embodiment shown, the controller receives three pulses (one for each marker 215) per revolution of the shaft. It will be appreciated that the invention is not limited in this regard and that substantially any suitable number of markers 215 (one or more) may be utilized. Furthermore, in alternative embodiments, the sensor(s) may be deployed on the shaft 115 and the marker(s) may be deployed on the housing 110.

In one advantageous embodiment, sensor 210 includes a Hall-effect sensor and markers 215 are magnetic markers, although the invention is not limited in this regard. Other sensor and marker arrangements may be utilized. For example, in one alternative embodiment, sensor arrangement 200 may include an infrared sensor configured to sense a marker including, for example, a mirror reflecting infrared radiation from a source located near the sensor. In another alternative embodiment, sensor arrangement 200 may include one or more ultrasonic receivers (sensors) and ultrasonic transmitters (markers) deployed on the shaft 215 and housing 210. In still another alternative embodiment, sensor arrangement 200 may include one or more electrical switches (sensors) and a plurality of cams (markers) disposed to open and close the switches as they rotate past one another.

Figure 4:
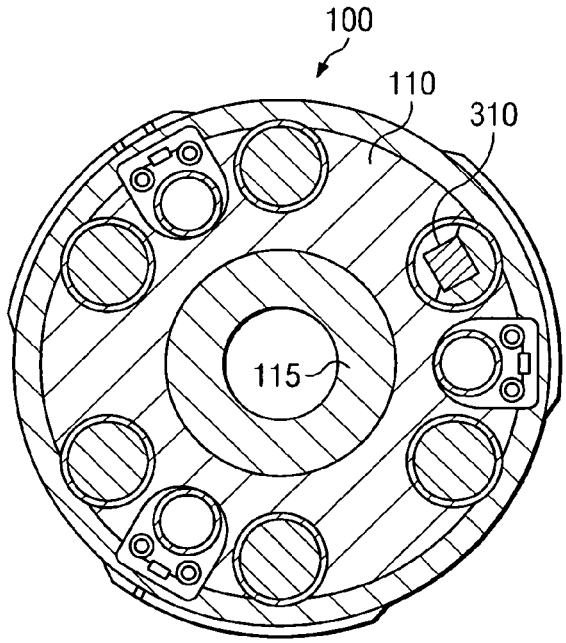
FIG. 4 depicts one exemplary method embodiment of the present invention in flowchart form.

With reference now to FIG. 4, one exemplary method embodiment 400 for quantifying stick/slip downhole in accordance with the present invention is illustrated in flow chart form. A rotary steerable tool (such as that shown on FIG. 2) is deployed in a subterranean borehole at 402. As described above, the rotary steerable tool includes a shaft that rotates in a substantially non-rotating housing during drilling. At 404 the average and instantaneous rotation rates of the shaft are measured as a function of time, for example, as described below with respects to Equations 1 and 2. At 406, the measured rotation rates are processed to determine a stick/slip parameter. The stick/slip parameter may then be transmitted to the surface at 408, for example, using conventional telemetry techniques such as mud pulse telemetry.

The rotation rates of the shaft 115 may be determined at 404, for example, by counting the number of sensed pulses in a predetermined time period. This may be expressed mathematically, for example, as follows:

$$RPM = \frac{N}{\Delta t} \cdot \frac{60}{n} \quad \text{Equation 1}$$

where RPM represents the rotation rate of the shaft 115 in revolutions per minute, N represents the number of pulses recorded in the predetermine time period, At represents the length of the predetermined time period in seconds, and n represents the number of magnetic markers utilized in sensor 200 (e.g., 3 as shown on FIG. 4). An average rotation rate of the shaft may be determined by counting pulses over a relatively long predetermined time period, for example, from about 10 to about 60 seconds. To illustrate, if 75 pulses are sensed in a predetermined time period of 20 seconds for a sensor arrangement having 3 markers, Equation 1 yields an average rotation rate of 75 rpm. Instantaneous rotation rates may be determined by counting pulses over relatively shorter predetermined time periods, for example, from about 0.5 to 4 seconds. To illustrate further, if 10 pulses are sensed in a predetermined time period of 1 second for the same sensor arrangement, Equation 1 yields an instantaneous rotation rate of 200 rpm.

The rotation rates may also be determined at 404 from the elapsed time interval between one or more pulses. This may be expressed mathematically, for example, as follows:

$$RPM = \frac{60m}{n \cdot \delta t} \quad \text{Equation 2}$$

where RPM and n are as defined above in Equation 1 and δt represents the time interval between the m pulses in seconds. Equation 2 may also be utilized to determine both instantaneous and average rotation rates. To determine an instantaneous rotation rate, m is typically in the range from about 1 to 10. To determine an average rotation rates, m is typically in the range from about 50 to 200. To illustrate, an elapsed time interval δt of 0.1 second between sequential pulses (m=1) for a sensor arrangement having 3 markers yields an instantaneous rotation rate of 200 rpm. It will be appreciated that in moderate to severe stick/slip conditions, the drill string (and therefore shaft 215) can stop rotating for up to several seconds. In such conditions it may be advantageous to set a predetermined maximum elapsed time interval between sequential pulses. For example, if no pulses are sensed for a whole second (a rotation rate of 20 rpm or less in an embodiment having three markers), then the rotation rate may be arbitrarily set to zero until the next pulse is received. It will be appreciated that such an approach is consistent with stick/slip conditions in which a drill string essentially stops rotating for some period of time due to frictional forces and then rotates rapidly for a short period of time during which the tensional energy is released.

With continued reference to FIG. 4, a stick/slip parameter may be quantified mathematically at 406, for example, as follows:

$$SSN = \frac{RPM_{\mathrm{MAX}} - RPM_{\mathrm{MIN}}}{RPM_{AVE}} \approx \frac{RPM_{\mathrm{MAX}}}{RPM_{AVE}} \quad \text{Equation 3}$$

where SSN represents a normalized stick/slip parameter, $RPM_{MAX}$ and $RPM_{MIN}$ represent maximum and minimum instantaneous rotation rates during some predetermined time period, and $RPM_{AVE}$ represents the average rotation rate during the predetermine time period (e.g., 20 seconds).

It will, of course, be appreciated that the stick/slip parameter SS need not be normalized as shown in Equation 3, but may instead be expressed as the difference between the maximum and minimum instantaneous rotation rates as follows:

$$SS = RPM_{MAX} - RPM_{MIN} \approx RPM_{MAX} \quad \text{Equation 4}$$

In many applications, as described above, stick/slip conditions cause the drill string to temporarily stop rotating (i.e., $RPM_{MIN}=0$). In such conditions, as shown in Equations 3 and 4, the stick/slip parameter is essentially equal to or proportional to the maximum instantaneous rotation rate. As such, it will be understood that $RPM_{MAX}$ may be a suitable alternative metric for quantifying stick/slip conditions. Such an alternative metric may be suitable for many applications, especially since damage and wear to the drill bit, rotary steerable tool, and other downhole tools is generally understood to be related to the maximum instantaneous drill string rotation rate.

It will, of course, be appreciated that the sensor pulses need not be converted to rotation rates in order to determine the stick/slip parameter. For example, SS and SSN may also be equivalently expressed mathematically as follows:

$$SS = N_{\mathrm{MAX}} - N_{\mathrm{MIN}} \approx N_{\mathrm{MAX}} \quad \text{Equation 5}$$

$$SSN = \frac{N_{\mathrm{MAX}} - N_{\mathrm{MIN}}}{N_{AVE}} \approx \frac{N_{\mathrm{MAX}}}{N_{AVE}} \quad \text{Equation 6}$$

where SS and SSN are as defined above, $N_{MIN}$ and $N_{MAX}$ represent the minimum and maximum number of pulses recorded during a plurality of short duration time periods, and $N_{AVE}$ represents the average number of pulses recorded in the plurality of short time periods.

A suitable stick/slip parameter may also be determined by differentiating the sensor pulses (e.g., the Hall-effect counts) or the rotation rate of the shaft as a function time. For example, stick/slip and/or normalized stick/slip parameters may alternatively be expressed mathematically, for example, as follows:

$$SS = \left|\frac{d(RPM(t))}{dt}\right| = |RPM(t) - RPM(t-1)| \quad \text{Equation 7}$$

$$SSN = \frac{\left|\frac{d(RPM(t))}{dt}\right|}{RPM_{AVE}} = \frac{|RPM(t) - RPM(t-1)|}{RPM_{AVE}} \quad \text{Equation 8}$$

where SS and SSN represent stick/slip and normalized stick/slip parameters, d(RPM(t))/dt represents the differential of the instantaneous rotation rate with time, and RPM(t) and RPM(t−1) represent instantaneous rotation rates of the shaft in sequential time periods. It will be appreciated by those of ordinary skill in the art that Equations 7 and 8 essentially determine the variability of the rotation rate (or the instantaneous rotation rate) with time. As described above, stick/slip conditions typically result in a highly variable rotation rate. It will also be appreciated, that such variability (and therefore a stick/slip parameter) may be equivalently determined by differentiating (i) the number of electrical pulses as a function of time or (ii) the time interval δt between pulses (or groups of pulses). It will also be appreciated that the normalized stick/slip parameter can be noisy when the average rotation rate is relatively small (e.g., 10 RPM or less). To prevent false notification of severe stick/slip (due to the measurement noise), the firmware may include instructions, for example, to ignore normalized stick/slip parameters when the average rotation rate is less than some predetermined threshold.

Referring now to FIG. 5, one exemplary embodiment of sensor arrangement 300 is shown in cross section. Sensor 300 includes a sensor set 310 including a tri-axial arrangement of accelerometers deployed in housing 110 of rotary steerable tool 100. In the exemplary embodiment shown, x- and y-axis accelerometers are aligned tangentially and radically, respectively, in housing 110, although the invention is not limited in this regard. A z-axis accelerometer will be understood to be aligned with the longitudinal axis of the rotary steerable tool 100. Sensor arrangement 300 may optionally include additional accelerometers, for example, second x- and y-axis accelerometers diametrically opposed from sensor set 310. Such additional accelerometers may advantageously enable tangential and centripetal acceleration components (e.g., due to stick/slip conditions) to be canceled out.

Suitable accelerometers for use in sensor 300 are preferably chosen from among commercially available devices known in the art. For example, suitable accelerometers may include Part Number 979-0273-001 commercially available from Honeywell, and Part Number JA-5H175-1 commercially available from Japan Aviation Electronics Industry, Ltd. (JAE). Suitable accelerometers may alternatively include micro-electro-mechanical systems (MEMS) solid-state accelerometers, available, for example, from Analog Devices, Inc. (Norwood, Mass.). Such MEMS accelerometers may be advantageous for certain rotary steerable applications since they tend to be shock resistant, high-temperature rated, and inexpensive.

The use of a tri-axial arrangement of accelerometers for determining survey parameters, such as tool face and borehole inclination, is known in the art. Since housing 110 is substantially non-rotating with respect to the borehole, the x, y, and z components of the gravitational field (measured by the tri-axial arrangement of accelerometers) may be utilized to determine gravity tool face and inclination of the rotary steerable tool. This may be accomplished, for example, by averaging the accelerometer measurements over a predetermined period of time (e.g., from about 10 to about 60 seconds) to essentially average out the effects of tool vibration and using the following known equations:

$$GTF = \arctan\left(\frac{G_X}{G_Y}\right) \quad \text{Equation 9}$$

$$\begin{aligned} Inc &= \arctan\left(\frac{\sqrt{G_X^2 + G_Y^2}}{G_Z}\right) \\ &= \arccos\left(\frac{G_Z}{\sqrt{G_X^2 + G_Y^2 + G_Z^2}}\right) \\ &\approx \arccos(G_Z) \end{aligned} \quad \text{Equation 10}$$

. . . assuming $\sqrt{G_X^2+G_y^2+G_z^2}$ is approximately 1G where GTF represents the gravity tool face, Inc represents the inclination, and $G_x$, $G_y$, and $G_z$ represent the time-averaged x, y, and z components of the gravitational field. As described in more detail below, sensor set 310 (including the tri-axial arrangement of accelerometers) may also be advantageously utilized to simultaneously determine axial (bit bounce) and lateral vibration components during drilling.

Figure 6:
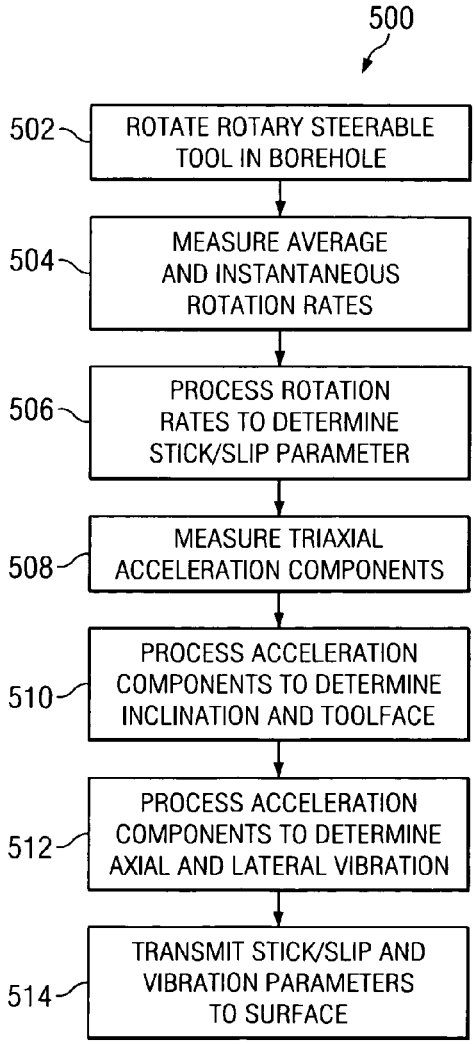
FIG. 6 depicts another exemplary method embodiment of the present invention in flowchart form.

With reference now to FIG. 6, another exemplary method embodiment 500 in accordance with the present invention is illustrated in flow chart form. A rotary steerable tool (such as that shown on FIG. 2) is deployed in a subterranean borehole at 502. As described above, the rotary steerable tool includes a shaft that rotates in a substantially non-rotating housing during drilling. At 504, instantaneous and average rotation rates of the shaft may be measured as described above. At 506, the rotation rates are processed to determine a stick/slip parameter, for example, as also described above. At 508, tri-axial acceleration components of the rotary steerable tool housing 110 are measured. At 510 and 512, respectively, the tri-axial acceleration components are processed to substantially simultaneously determine inclination and tool face and axial and lateral vibration components. The stick/slip parameter and tool vibration components may then be transmitted to the surface at 514, for example, using conventional telemetry techniques such as mud pulse telemetry.

The accelerometer measurements are typically averaged over relatively short time intervals (e.g., from about 0.1 to about 1 second intervals) to determine substantially instantaneous tri-axial acceleration components. Tool vibration components (e.g., bit bounce and lateral vibration) may then be determined at 512 from the instantaneous acceleration components. It will be appreciated that tool vibration components are typically determined along each of the tool axes (x, y, and z). For example, a bit bounce parameter may be determined from the z-axis (axial) acceleration measurements and a lateral vibration parameter may be determined from the x- and y-axis (cross-axial) acceleration components. Tool vibration components may be determined mathematically, for example, as follows:

$$TV = |G_i - G_{iAVE}| \quad \text{Equation 11}$$

$$TV = |G_{iMAX} - G_{iMIN}| \quad \text{Equation 12}$$

$$TV = |G_{iMAX} - G_{iAVE}| \quad \text{Equation 13}$$

$$TV = |G_{iMIN} - G_{iAVE}| \quad \text{Equation 14}$$

$$TV = \left|\frac{d(G_i(t))}{dt}\right| = |G_i(t) - G_i(t-1)| \quad \text{Equation 15}$$

where TV represents a tool vibration component (e.g., bit bounce or a lateral vibration component), i represents one of the x, y, or z axes such that $G_i$ represents an instantaneous acceleration component along one of the x, y, or z axes, $G_{iAVE}$ represents an average acceleration component over a relatively longer period of time (e.g., from about 10 to 60 seconds to determine the gravitational acceleration component), $G_{iMAX}$ and $G_{iMIN}$ represent maximum and minimum instantaneous acceleration components during a relatively longer period of time, and $G_i(t)$ and $G_i(t-1)$ represent sequential instantaneous acceleration components. It will, of course, be appreciated that the tool vibration components determined in Equations 11-15 can also be normalized, for example, as shown above with respect to the stick/slip parameter in Equations 3 and 8.

While housing 110 (FIG. 2) is substantially non-rotating during drilling (as described above), it can slip or rotate in the borehole from time to time. This brief rotation may cause centripetal and tangential acceleration of the housing, which, if unaccounted, may be falsely attributed to a lateral vibration. Such housing rotation may be accounted for through the use of additional accelerometer deployments as described above. Alternatively, rotation of the housing 110 may be detected via changes in the gravity tool face. In the event that the change in tool face exceeds a predetermined threshold (indicating excessive housing rotation), lateral vibration may be ignored.

Exemplary method embodiments in accordance with this invention advantageously enable downhole dynamics to be determined using existing rotary steerable sensor deployments. Such methods may therefore improve tool reliability as compared to prior art dynamics measurement systems in that additional, dedicated sensor deployments are not required. Moreover, the sensors (e.g., the Hall-effect sensor and accelerometers) are all deployed in the rotary steerable housing. Such deployment is also advantageously very low in the BHA (i.e., close to the drill bit) and in close proximity to sensitive rotary steerable electronics and hydraulics components in the rotary steerable housing. It will be understood that due to the mechanical coupling of the housing and shaft (e.g., via thrust bearings and bearing packs) vibration measurements made in the housing, while not direct measurements of drill bit vibration, are typically indicative of (e.g., proportional to) vibration at the drill bit and elsewhere in the BHA.

With continued reference to FIG. 6 and reference again to FIG. 4, downhole dynamics parameters (stick/slip, bit bounce, and lateral vibration parameters) may be telemeter to the surface at 408 and 514 using substantially any known telemetry techniques. It will be appreciated that it is typically desirable to telemeter the dynamics parameter(s) in substantially real time so that corrective measures can be implemented during drilling if necessary. Due to the bandwidth constraints of conventional telemetry techniques (e.g., mud pulse telemetry), each of the dynamics parameters is typically reduced to a two-bit value (i.e., four levels; very low, low, medium, and high). One exemplary encoding embodiment is shown in Tables 1 and 2 (the invention is, of course, not limited in this regard).

TABLE 1

Normalized Stick/Slip Parameter

| Normalized Stick/Slip | Level | Binary Representation |
|---|---|---|
| <50% | Very Low | 00 |
| 50-100% | Low | 01 |
| 100-150% | Medium | 10 |
| >150% | High | 11 |

TABLE 2

Bit Bounce and Lateral Vibration

| Bit Bounce/Lateral Vibration | Level | Binary Representation |
|---|---|---|
| <1 G | Very Low | 00 |
| 1-2 G | Low | 01 |
| 2-3 G | Medium | 10 |
| >3 G | High | 11 |

It will be understood that the telemeter dynamics parameters may be advantageously used in combination with surface indications of downhole dynamic conditions. For example, in shallow wells, stick/slip is often manifest as a variation in surface torque (or even a temporarily stalled drill string in severe conditions). A driller may optionally compare and contrast surface torque with the telemeter stick/slip parameter to obtain a more complete understanding of downhole stick/slip conditions.

It will also be understood that the dynamics components (stick/slip and tool vibration) may be advantageously saved to downhole memory with much greater precision and frequency than they can be telemeter to the surface (due to the constraints bandwidth constraints of conventional telemetry techniques). This enables analysis of the dynamics data after the rotary steerable tool has been tripped out of the borehole (e.g., after completion of the well). Such post-run analysis may be advantageously utilized for a variety of purposes, for example, including improving the drill bit and rotary steerable configurations and correlating tool wear and failure with particular dynamics conditions. The saved dynamics data may also be correlated with surface observations recorded in a drilling log.

Figure 7:
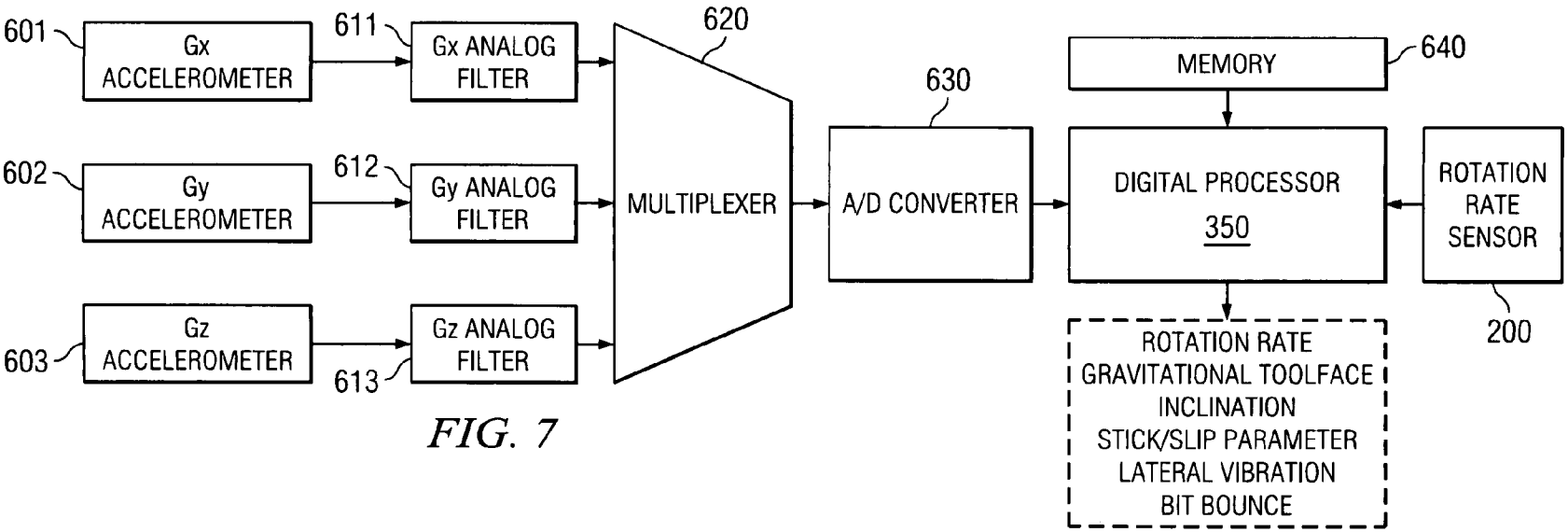
FIG. 7 depicts a block diagram of an exemplary control circuit in accordance with the present invention.

Referring now to FIG. 7, a block diagram of one exemplary embodiment of a signal processing circuit 600 in accordance with this invention is shown. It will be understood that signal processing circuit 600 is configured for use with sensor arrangements similar to those shown on FIGS. 2, 3, and 5, in which a rotary steerable tool includes a rotation rate sensor and a tri-axial arrangement of accelerometers. It will be further understood that signal processing aspects of this invention are not limited to use with sensors having any particular number of accelerometers or rotation rate sensors. In the exemplary circuit embodiment shown, accelerometers 601-603 are electrically coupled to low-pass filters 611-613. The filters 611-613 may also function to convert the accelerometer output from current signals to voltage signals. The filtered voltage signals are coupled to an Analog-to-Digital (A/D) converter 630 through multiplexer 620 such that the output of the A/D converter 630 includes digital signals representative of low-pass filtered accelerometer values. In one exemplary embodiment, A/D converter 630 includes a 16-bit A/D device, such as the AD7654 available from Analog Devices, Inc. (Norwood, Mass.).

In the exemplary embodiment shown, A/D converter 630 is electronically coupled to a digital processor 650, for example, via a 16-bit bus. Substantially any suitable digital processor may be utilized, for example, including an ADSP-2191M microprocessor, available from Analog Devices, Inc. In the exemplary embodiment shown, rotation rate sensor 200 (FIG. 1) is also electronically coupled with digital processor 650.

It will be understood that while not shown in FIGS. 1, 2, 3, and 5, rotary steerable tool embodiments of this invention typically include an electronic controller. Such a controller typically includes signal processing circuit 600 including digital processor 650, A/D converter 630, and a processor readable memory device 640 and/or a data storage device. The controller may also include processor-readable or computer-readable program code embodying logic, including instructions for continuously computing instantaneous and average drill string rotation rates and a stick/slip parameter there from. Such instructions may include, for example, the algorithms set forth above in Equations 1 through 8. The controller may further include instructions to receive rotation-encoded commands from the surface and to cause the rotary steerable tool 100 to execute such commands upon receipt. The controller may further include instructions for computing gravity tool face and borehole inclination, for example, as set forth above in Equations 9 and 10, as well as tool vibration components as set forth above in Equations 11 through 15. One skilled in the art will also readily recognize that the above mentioned equations may also be solved using hardware mechanisms (i.e., analog or digital circuits). For example, the raw signal or the low-pass filtered signal from the accelerometers could be AC-coupled to different channels of the A/D converter. In this case, the mathematical operation of Equation 11 ($|G_t - G_{AVE}|$), for example, may be accomplished in the hardware (e.g., by removing a DC offset as indicated).

A suitable controller typically includes a timer including, for example, an incrementing counter, a decrementing time-out counter, or a real-time clock. The controller may further include multiple data storage devices, various sensors, other controllable components, a power supply, and the like. The controller may also include conventional receiving electronics, for receiving and amplifying pulses from sensor 200. The controller may also optionally communicate with other instruments in the drill string, such as telemetry systems that communicate with the surface. It will be appreciated that the controller is not necessarily located in the rotary steerable tool 100, but may be disposed elsewhere in the drill string in electronic communication therewith. Moreover, one skilled in the art will readily recognize that the multiple functions described above may be distributed among a number of electronic devices (controllers).

Although the present invention and its advantages have been described in detail, it should be understood that various changes, substitutions and alternations can be made herein without departing from the spirit and scope of the invention as defined by the appended claims.

I claim:

1. A rotary steerable tool configured to operate in a borehole, the rotary steerable tool comprising:

a shaft;

a housing deployed about the shaft, the shaft disposed to rotate substantially freely in the housing;

a rotation rate measurement device disposed to measure a rotation rate of the shaft relative to the housing, the rotation rate measurement device including at least one sensor and at least one marker, the sensor disposed to send an electrical pulse to a controller each time one of the markers and the sensor rotate past one another; and the controller configured to calculate instantaneous and average rotation rates of the shaft relative to the housing from said electrical pulses and to further calculate a stick/slip parameter from said electric pulses.

2. The rotary steerable tool of claim 1, wherein the controller is configured to calculate the stick/slip parameter according to an equation selected from the group consisting of:

$$SS = RPM_{\mathrm{MAX}} - RPM_{\mathrm{MIN}} \approx RPM_{\mathrm{MAX}};$$

$$SSN = \frac{RPM_{\mathrm{MAX}} - RPM_{\mathrm{MIN}}}{RPM_{AVE}} \approx \frac{RPM_{\mathrm{MAX}}}{RPM_{AVE}};$$

$$SS = N_{\mathrm{MAX}} - N_{\mathrm{MIN}} \approx N_{\mathrm{MAX}};$$

$$SSN = \frac{N_{\mathrm{MAX}} - N_{\mathrm{MIN}}}{N_{AVE}} \approx \frac{N_{\mathrm{MAX}}}{N_{AVE}};$$

$$SS = \left|\frac{d(RPM(t))}{dt}\right| = |RPM(t) - RPM(t-1)|; \text{ and}$$

-continued $$SSN = \frac{\left|\frac{d(RPM(t))}{dt}\right|}{RPM_{AVE}} = \frac{|RPM(t) - RPM(t-1)|}{RPM_{AVE}};$$

where SSN represents the stick/slip parameter normalized, SS represents the stick/slip parameter, $RPM_{MAX}$, $RPM_{MIN}$, and $RPM_{AVE}$ represent a maximum instantaneous rotation rate, a minimum instantaneous rotation rate, and an average rotation rate of the shaft, respectively, $N_{MAX}$ and $N_{MIN}$ represent maximum and minimum numbers of the electrical pulses, $N_{AVE}$ represents an average number of the electrical pulsos, d(RPM(t))/dt represents the differential of an instantaneous rotation rate with time, and RPM(t) and RPM(t-1) represent instantaneous rotation rates of the shaft in sequential time periods.

3. The rotary steerable tool of claim 1 wherein the controller is further configured to calculate the rotation rate of the shaft according to at least one equation from the group consisting of:

$$RPM = \frac{N}{\Delta t} \cdot \frac{60}{n}; \text{ and } RPM = \frac{60m}{n \cdot \delta t};$$

where RPM represents the rotation rate of the shaft in revolutions per minute, N represents a number of electrical pulses in a predetermined time period, Δt represents a length of time of the predetermined time period in seconds, n represents a number of markers utilized in the rotation rate measurement device, and δt represents a time interval between the m electrical pulses in seconds.

4. The rotary steerable tool of claim 1, wherein the rotation rate measurement device comprises a Hall-effect sensor deployed in the housing and a plurality of magnetic markers deployed on the shaft.

5. The rotary steerable tool of claim 1, further comprising:

a tri-axial arrangement of accelerometers deployed in the housing, one of the accelerometers substantially aligned with a longitudinal axis of the rotary steerable tool, the accelerometers disposed to measure tri-axial acceleration components of the housing.

6. The rotary steerable tool of claim 5, wherein the controller is further configured to determine a bit bounce parameter and a lateral vibration parameter from said measured tri-axial acceleration components.

7. The rotary steerable tool of claim 6, wherein the controller is further configured to determine borehole inclination and gravity tool face from said measured tri-axial acceleration components.

8. The rotary steerable tool of claim 6, wherein the controller is further configured to determine (i) the bit bounce parameter from a difference between instantaneous and average axial acceleration components and (ii) the lateral vibration parameter from a difference between instantaneous and avenge cross axial acceleration components.

9. A rotary steerable tool configured to operate in a borehole, the rotary steerable tool comprising:

a shaft;

a housing deployed about the shaft, the shaft disposed to rotate substantially freely in the housing;

a rotation rate measurement device disposed to measure a rotation rate of the shaft relative to the housing, the rotation rate measurement device including at least one sensor and a plurality of markers, the sensor disposed to send an electrical pulse to a controller each time one of the markers and the sensor rotate past one another;

a tri-axial accelerometer set deployed in the housing, the accelerometer set disposed to measure acceleration of the housing; and the controller configured to determine (i) instantaneous and average rotation rates of the shaft from said electrical pulses, (ii) a stick/slip parameter from said instantaneous rotation rates, (iii) instantaneous and average tri-axial acceleration components from said accelerometer measurements, (iv) borehole inclination and gravity tool face from the average tri-axial acceleration components, and (v) bit bounce and lateral vibration parameters from the instantaneous tri-axial acceleration components.

10. The rotary steerable tool of claim 9, wherein the rotation rate measurement device comprises a Hall-effect sensor deployed in the housing and a plurality of magnetic markers deployed on the shaft.

11. The rotary steerable tool of claim 9, further comprising:

downhole memory suitable for storing the following parameters at predetermined time intervals during drilling; (i) the instantaneous and average rotation rates of the shaft, (ii) the stick/slip parameter, (iii) the instantaneous and average tri-axial acceleration components, (iv) borehole inclination and gravity tool face, and (v) the bit bounce and lateral vibration parameters.

12. The rotary steerable tool of claim 9, wherein the controller is in electronic communication with a telemetry device configured to telemeter selected ones of the stick/slip parameter, the bit bounce parameter, and the lateral vibration parameter to a surface location.

13. The rotary steerable tool of claim 9, wherein:

the controller is configured to calculate the stick/slip parameter according to at least one equation selected from the group consisting of:

$$SS = RPM_{\mathrm{MAX}} - RPM_{\mathrm{MIN}} \approx RPM_{\mathrm{MAX}};$$

$$SSN = \frac{RPM_{\mathrm{MAX}} - RPM_{\mathrm{MIN}}}{RPM_{AVE}} \approx \frac{RPM_{\mathrm{MAX}}}{RPM_{AVE}};$$

$$SS = N_{\mathrm{MAX}} - N_{\mathrm{MIN}} \approx N_{\mathrm{MAX}};$$

$$SSN = \frac{N_{\mathrm{MAX}} - N_{\mathrm{MIN}}}{N_{AVE}} \approx \frac{N_{\mathrm{MAX}}}{N_{AVE}};$$

$$SS = \left|\frac{d(RPM(t))}{dt}\right| = |RPM(t) - RPM(t-1)|; \text{ and}$$

$$SSN = \frac{\left|\frac{d(RPM(t))}{dt}\right|}{RPM_{AVE}} = \frac{|RPM(t) - RPM(t-1)|}{RPM_{AVE}};$$

where SSN represents the stick/slip parameter normalized, SS represents the stick/slip parameter, $RPM_{MAX}$, $RPM_{MIN}$, and $RPM_{AVE}$ represent a maximum instantaneous rotation rate, a minimum instantaneous rotation rate, and an average rotation rate of the shaft, respectively, $N_{MAX}$ and $N_{MIN}$ represent maximum and minimum numbers of the electrical pulses, $N_{AVE}$ represents an average number of the electrical pulses, d(RPM(t))/dt represents the differential of an instantaneous rotation rate with time, and RPM(t) and RPM(t-1) represent instantaneous rotation rates of the shaft in sequential time periods.

14. The rotary steerable tool of claim 9, wherein:

the controller is configured to calculate the bit bounce and lateral vibration parameters according to at least one equation selected from the group consisting of:

$$TV = |G_i - G_{iAVE}|;$$

$$TV = |G_{iMAX} - G_{iMIN}|;$$

$$TV = |G_{iMAX} - G_{iAVE}|;$$

$$TV = |G_{iMIN} - G_{iAVE}|; \text{ and}$$

$$TV = \left|\frac{d(G_i(t))}{dt}\right| = |G_i(t) - G_i(t-1)|;$$

where TV represents one of the bit bounce and lateral vibration parameters, $G_i$ represents an instantaneous acceleration component along one of x, y, and axes, $G_{iAVE}$ represents an average acceleration component, $G_{iMAX}$ and $G_{iMIN}$ represent maximum and minimum instantaneous acceleration components, and $G_i(t)$ and $G_i(t-1)$ represent sequential instantaneous acceleration components.

15. A method for determining a stick/slip parameter downhole during drilling of subterranean borehole, the method comprising:

(a) rotating a string of tools in a borehole, the string of tools including a rotary steerable tool and a drill bit rotationally coupled with a drill sting, the rotary steerable tool including a shaft disposed to rotate substantially freely in a housing, the rotary steerable tool further including a rotation rate measurement device disposed to measure a rotation rate of the shaft relative to the housing, the rotation rate measurement device having at least one sensor and a plurality of markers, the sensor disposed to send an electrical pulse to a controller each time one of the markers and the sensor rotate past one another; and (b) processing said electrical pulses to determine the stick/slip parameter,the stick/slip parameter being determined according to at least one equation of the group consisting of:

$$SS = RPM_{\mathrm{MAX}} - RPM_{\mathrm{MIN}} \approx RPM_{\mathrm{MAX}};$$

$$SSN = \frac{RPM_{\mathrm{MAX}} - RPM_{\mathrm{MIN}}}{RPM_{AVE}} \approx \frac{RPM_{\mathrm{MAX}}}{RPM_{AVE}};$$

$$SS = N_{\mathrm{MAX}} - N_{\mathrm{MIN}} \approx N_{\mathrm{MAX}};$$

$$SSN = \frac{N_{\mathrm{MAX}} - N_{\mathrm{MIN}}}{N_{AVE}} \approx \frac{N_{\mathrm{MAX}}}{N_{AVE}};$$

$$SS = \left|\frac{d(RPM(t))}{dt}\right| = |RPM(t) - RPM(t-1)|; \text{ and}$$

$$SSN = \frac{\left|\frac{d(RPM(t))}{dt}\right|}{RPM_{AVE}} = \frac{|RPM(t) - RPM(t-1)|}{RPM_{AVE}};$$

wherein SSN represents the stick/slip parameter normalized, SS represents the stick/slip parameter, $RPM_{MAX}$, $RPM_{MIN}$, and $RPM_{AVE}$ represent a maximum instantaneous rotation rate, a minimum instantaneous rotation rate, and an average rotation rate of the shaft, respectively, $N_{MAX}$ and $N_{MIN}$ represent maximum and minimum numbers of the electrical pulses, $N_{AVE}$ represents an average number of the electrical pulses, d(RPM(t))/dt represents the differential of an instantaneous rotation rate with time, and RPM(t) and RPM(t−1) represent instantaneous rotation rates of the shaft in sequential time periods.

16. The method of claim 15, further comprising:

(c) telemetering said stick/slip parameter to a surface location.

17. The method of claim 15, wherein:

the rotary steerable tool further includes a tri-axial arrangement of accelerometers deployed in the housing, one of the accelerometers substantially aligned with a longitudinal axis of the rotary steerable tool, and the method further comprises:

(c) causing the accelerometers to measure tri-axial acceleration components of the housing; and (d) processing said tri-axial acceleration components measured in (c) to determine at least one of a bit bounce parameter and a lateral vibration parameter.

18. The method of claim 17, wherein (d) further comprises:

(i) processing a difference between instantaneous and average axial acceleration components measured in (c) to determine the bit bounce parameter; and (ii) processing a difference between instantaneous and average cross axial acceleration components measured in (c) to determine the lateral vibration parameter.

19. The method of claim 17, further comprising:

(e) processing said tri-axial acceleration components measured in (c) to determine borehole inclination and gravity tool face.

20. The method of claim 17, wherein the bit bounce parameter and the lateral vibration parameter are determined in (d) according to at least one equation selected from the group consisting of:

$$TV = |G_i - G_{iAVE}|$$

$$TV = |G_{iMAX} - G_{iMIN}|$$

$$TV = |G_{iMAX} - G_{iAVE}|;$$

$$TV = |G_{iMIN} - G_{iAVE}|; \text{ and}$$

$$TV = \left|\frac{d(G_i(t))}{dt}\right| = |G_i(t) - G_i(t-1)|$$

where TV represents one of the bit bounce and lateral vibration parameters, $G_i$ represents an instantaneous acceleration component along one of x, y, and axes, $G_{iAVE}$ represents an average acceleration component, $G_{iMAX}$ and $G_{iMIN}$ represent maximum and minimum instantaneous acceleration components, and $G_i(t)$ and $G_i(t-1)$ represent sequential instantaneous acceleration components.

21. The method of claim 17, further comprising:

(c) telemetering the stick/slip parameter, the bit bounce parameter, and the lateral vibration parameter to a surface location.

22. A method for determining downhole dynamics parameters downhole during drilling of subterranean borehole, the method comprising:

(a) rotating a string of tools in a borehole, the string of tools including a rotary steerable tool and a drill bit rotationally coupled with a drill string, the rotary steerable tool including a shaft disposed to rotate substantially freely in a housing, the rotary steerable tool further including a rotation rate measurement device disposed to measure a rotation rate of the shaft relative to the housing, the rotation rate measurement device having at least one sensor and a plurality of markers, the sensor disposed to send an electrical pulse to a controller each time one of the markers and the sensor rotate past one another, the rotary steerable tool further including a tri-axial accelerometer set deployed in the housing;

(b) processing said electrical pulses to determine instantaneous and average rotation rates of the shaft;

(c) processing the instantaneous rotation rate to determine a stick/slip parameter;

(d) causing the accelerometers to measure tri-axial acceleration components of the housing; and (e) processing the tri-axial acceleration components measured in (d) to determine a bit bounce parameter and a lateral vibration parameter.

23. The method of claim 22, wherein the stick/slip parameter is determined in (c) according to at least one equation of the group consisting of:

$$SS = RPM_{MAX} - RPM_{MIN} \approx RPM_{MAX};$$

$$SSN = \frac{RPM_{MAX} - RPM_{MIN}}{RPM_{AVE}} \approx \frac{RPM_{MAX}}{RPM_{AVE}};$$

$$SS = N_{MAX} - N_{MIN} \approx N_{MAX};$$

$$SSN = \frac{N_{MAX} - N_{MIN}}{N_{AVE}} \approx \frac{N_{MAX}}{N_{AVE}};$$

$$SS = \left|\frac{d(RPM(t))}{dt}\right| = |RPM(t) - RPM(t-1)|; \text{ and}$$

$$SSN = \frac{\left|\frac{d(RPM(t))}{dt}\right|}{RPM_{AVE}} = \frac{|RPM(t) - RPM(t-1)|}{RPM_{AVE}};$$

where SSN represents the stick/slip parameter normalized, SS represents the stick/slip parameter, $RPM_{MAX}$, $RPM_{MIN}$, and $RPM_{AVE}$ represent a maximum instantaneous rotation rate, a minimum instantaneous rotation rate, and an average rotation rate of the shaft, respectively, $N_{MAX}$ and $N_{MIN}$ represent maximum and minimum numbers of the electrical pulses, $N_{AVE}$ represents an avenge number of the electrical pulses, d(RPM(t))/dt represents the differential of an instantaneous rotation rate with time, and RPM(t) and RPM(t−1) represent instantaneous rotation rates of the shaft in sequential time periods.

24. The method of claim 22, wherein the bit bounce parameter and the lateral vibration parameter are determined in (e) according to at least one equation selected from the group consisting of:

$$TV = |G_i - G_{iAVE}|$$

$$TV = |G_{iMAX} - G_{iMIN}|$$

$$TV = |G_{iMAX} - G_{iAVE}|;$$

$$TV = |G_{iMIN} - G_{iAVE}|; \text{ and}$$

$$TV = \left|\frac{d(G_i(t))}{dt}\right| = |G_i(t) - G_i(t-1)|$$

where TV represents one of the bit bounce and lateral vibration parameters, $C_i$ represents an instantaneous acceleration component along one of x, y, and axes, $G_{iAVE}$ represents an average acceleration component, $G_{iMAX}$ and $G_{iMIN}$ represent maximum and minimum instantaneous acceleration components, and $G_i(t)$ and $G_i(t-1)$ represent sequential instantaneous acceleration components.

25. The method of claim 22, further comprising:

(f) telemetering the stick/slip parameter, the bit bounce parameter, and the lateral vibration parameter to a surface location.

* * * * *